US005814191A

United States Patent [19]

Huovila

[11] Patent Number: 5,814,191

[45] Date of Patent: Sep. 29, 1998

[54] ARRANGEMENT AND METHOD FOR COMBINING A DILUTION FLOW WITH A STOCK FLOW PASSED OUT OF AN INLET HEADER IN A PAPER/BOARD MACHINE

[75] Inventor: Jyrki Huovila, Muurame, Finland

[73] Assignee: Valmet Corp., Helsinki, Finland

[21] Appl. No.: 879,597

[22] Filed: Jun. 20, 1997

[30] Foreign Application Priority Data

Jun. 20, 1996 [FI] Finland ..... 962567

[51] Int. Cl.[6] ..... D21F 1/08

[52] U.S. Cl. ..... 162/216; 162/212; 162/258; 162/343; 162/336

[58] Field of Search ..... 162/212, 216, 162/258, 259, 336, 339, 343, 338

[56] References Cited

U.S. PATENT DOCUMENTS

| | | | |
|---|---|---|---|
| 4,888,094 | 12/1989 | Weisshuhn et al. | 162/198 |
| 4,897,158 | 1/1990 | Weisshuhn et al. | 162/259 |
| 4,909,904 | 3/1990 | Kinzler | 162/343 |
| 5,030,326 | 7/1991 | Nous | 162/258 |
| 5,196,091 | 3/1993 | Hergert | 162/258 |
| 5,470,439 | 11/1995 | Makino et al. | 162/216 |
| 5,490,905 | 2/1996 | Huovila et al. | 162/212 |
| 5,545,293 | 8/1996 | Huovila et al. | 162/212 |
| 5,549,792 | 8/1996 | Begemann et al. | 162/216 |
| 5,549,793 | 8/1996 | Hellstrom et al. | 162/258 |
| 5,560,807 | 10/1996 | Hauser | 162/183 |
| 5,603,806 | 2/1997 | Kerttula | 162/198 |
| 5,626,722 | 5/1997 | Huovila | 162/343 |
| 5,674,364 | 10/1997 | Pitkäjärvi | 162/216 |
| 5,688,372 | 11/1997 | Houvila et al. | 162/212 |

FOREIGN PATENT DOCUMENTS

| | | | |
|---|---|---|---|
| 0 462 472 A1 | 12/1991 | European Pat. Off. | D21F 1/08 |
| 901593 | 10/1991 | Finland | D21F 1/02 |
| 92229 | 7/1993 | Finland . | |
| 964261 | 10/1996 | Finland . | |
| 970140 | 1/1997 | Finland . | |
| 44 16 898 C2 | 3/1996 | Germany | D21F 1/02 |
| WO 93/22495 | 11/1993 | WIPO | D21F 1/06 |

OTHER PUBLICATIONS

Claim 1 and Abstract of Valmet Paper Machinery Inc.'s Fl Pat. Appl. No. 946180, filed Dec. 30, 1994.

*Primary Examiner*—Stanley S. Silverman
*Assistant Examiner*—Jose A. Fortuna
*Attorney, Agent, or Firm*—Steinberg & Raskin, P.C.

[57] ABSTRACT

A method and apparatus for combining a dilution flow with a stock flow passed out of an inlet header in a paper/board machine including dilution flow ducts through which the dilution flow is passed to selected locations across the width of the headbox of the paper/board machine in order to regulate the basis weight of the paper/board web. The dilution flow ducts are constructed so that they becomes narrower toward a final, downstream end. Branch ducts are placed in the area of the narrowing portion of each flow duct, and the dilution flow is passed out of the branch ducts into the system of pipes wherein the dilution flow is combined with the stock flow passed out of the inlet header.

23 Claims, 11 Drawing Sheets

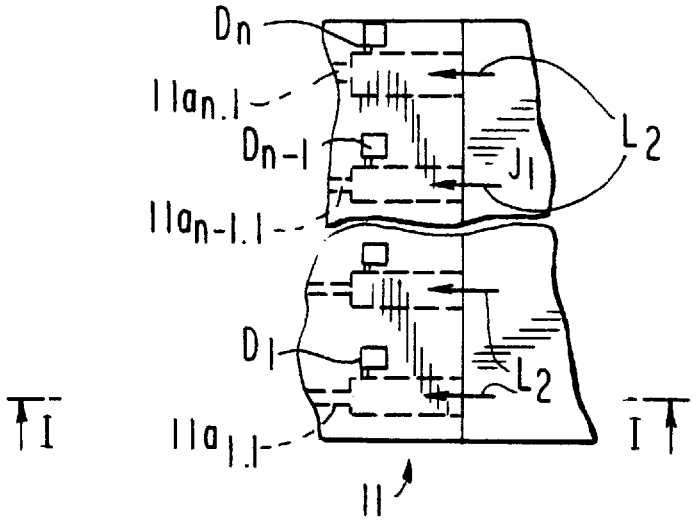
FIG. 1B
FIG. 8B
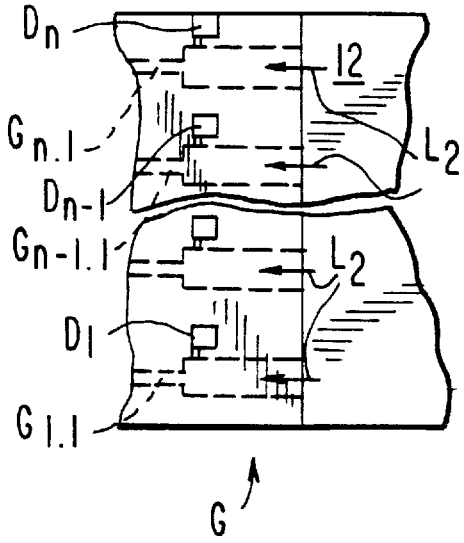

FIG. 4D
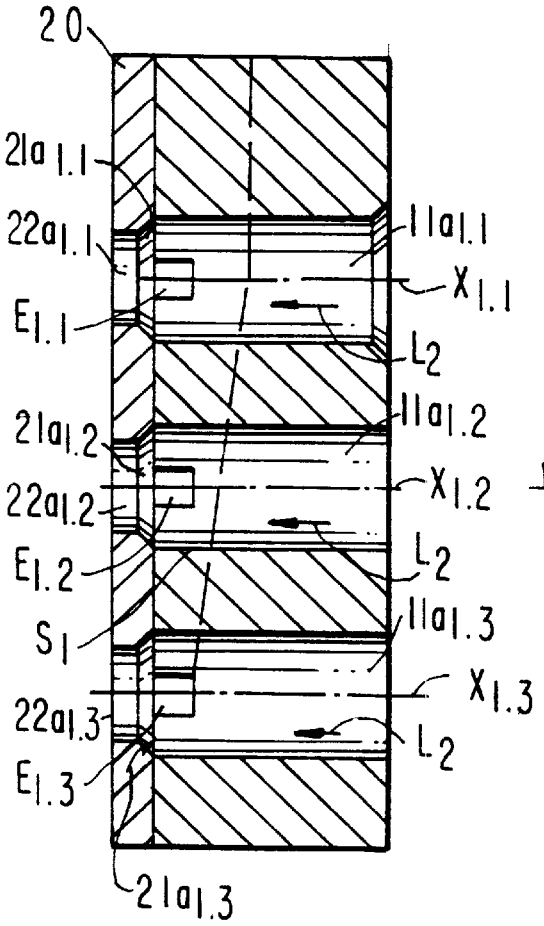
FIG. 7A
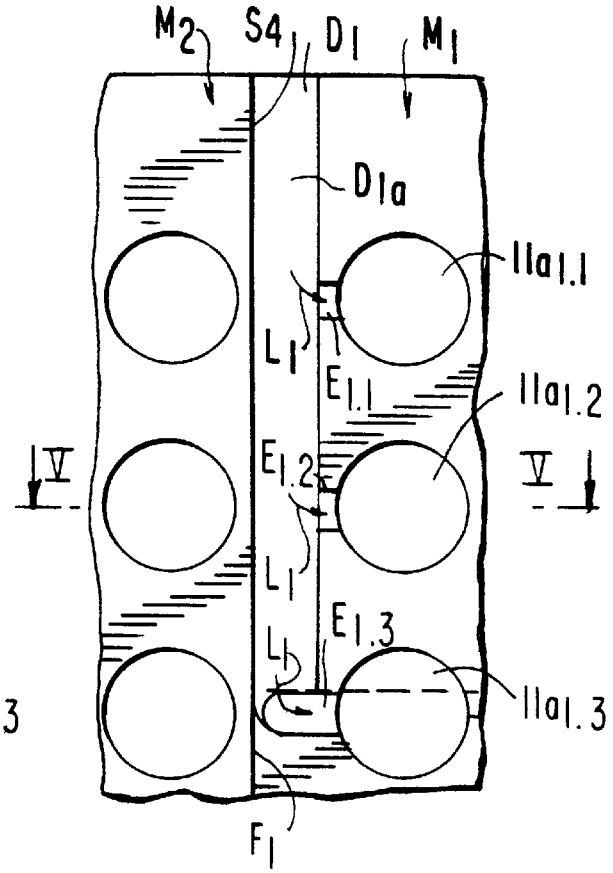
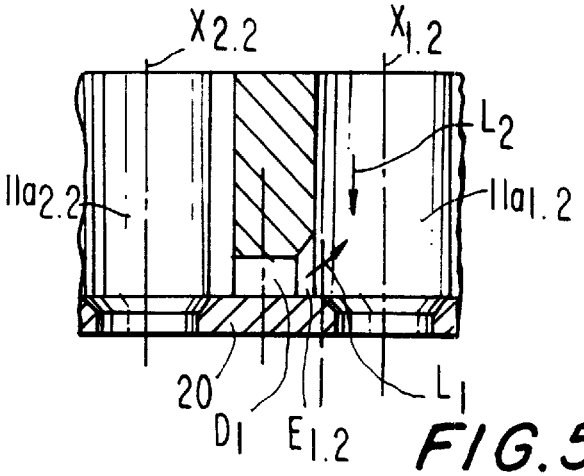
FIG. 5
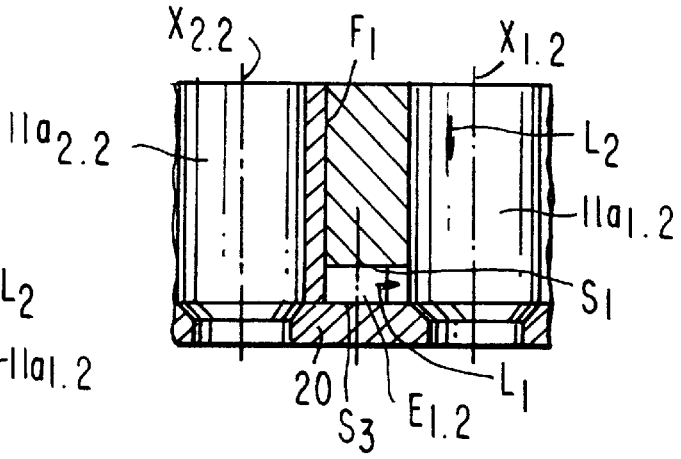
FIG. 7B

ARRANGEMENT AND METHOD FOR COMBINING A DILUTION FLOW WITH A STOCK FLOW PASSED OUT OF AN INLET HEADER IN A PAPER/BOARD MACHINE

FIELD OF THE INVENTION

The present invention relates to an arrangement and method for combining a dilution flow with a stock flow passed out of an inlet header in a paper/board machine. The present invention also relates to a dilution headbox and a method for regulating the basis weight of a web in a dilution headbox.

BACKGROUND OF THE INVENTION

From the current assignee's earlier Finnish Patent Application Nos. 901593 (and 946180 which is a "divisional" thereof), FI 933027 and FI 942780 (the latter two corresponding to U.S. Pat. No. 5,545,293 incorporated entirely by reference herein), a so-called dilution headbox is known, which is understood by those of ordinary skill in the art to refer to a headbox construction in which the basis weight of a web formed upon discharge from the headbox can be regulated across the width of the web by passing a dilution flow through valves to different locations of width of the headbox and by regulating the quantity of the dilution flow through each valve. The dilution flow is mixed with the stock flow passed out of the inlet header of the headbox. The dilution flow may consist of pure or fibrous liquid. Thus, the dilution water can be, for example, wire water removed from the web.

OBJECTS AND SUMMARY OF THE INVENTION

It is an object of the present invention to provide a new and improved dilution headbox.

It is another object of the present invention to provide a new and improved method and arrangement for combining a dilution flow with a stock flow passed out of an inlet header in a paper/board machine.

In order to achieve these objects, in the arrangement for combining a flow of dilution liquid with a flow of stock being passed from the inlet header of a paper/board machine, the dilution liquid is passed into connection with the stock flow passed from the inlet header preferably in connection with a tube manifold placed after the inlet header. The dilution liquid is preferably water. In the headbox construction in accordance with the invention, the basis weight of the web can be regulated across substantially the entire width of the wire by passing the desired dilution flow through one or more regulation valves to different locations across the width of the headbox. In accordance with the invention, the dilution flow may be passed into one or more of the horizontal rows of aligned pipes in the tube manifold and in each vertical column of aligned pipes, it may be passed into some or all the pipes positioned one above the other in the vertical column of pipes. In this manner, the mixing of the dilution flow with the stock flow passed out of the inlet header can be made as efficient as possible at each width location independent of the dilution flow mixing with the stock flow at other locations. More particularly, the dilution flow duct comprises a resilient pipe passed from the valve and out of which pipe the flow is distributed uniformly through a duct portion, which is defined by inclined walls, into each pipe in the rows of pipes in the tube manifold. The resilient pipes are preferably connected with the tube manifold. When a narrowing duct end is employed, the flow can be distributed evenly into all the pipes in the row of pipes in the tube manifold, also into the first pipe in the direction of flow of the dilution liquid. This avoids an uneven distribution of the dilution flow since a poorly distributed dilution flow increases the instability/residual scattering of the basis weight of the paper or board produced by the machine.

In accordance with the invention, the narrowing duct portion or section for the dilution flow is formed into a middle plate component so that one wall of the narrowing duct portion comprises a plate which is placed as the first plate in the flow direction of the stock flow and which contains the flow ducts for the stock flow from the inlet header. Further, in the construction, at the outlet side of the plate that contains the duct portion narrowing in the flow direction of the dilution flow, a third separate throttle plate is employed, which comprises throttle openings (one aligning with each flow duct in the first plate). In view of the throttle openings, the combined flow is mixed efficiently after the point of introduction of the dilution flow at the throttle point.

In the present application, when the term "throttle plate" is used, such a plate can also refer to a plate construction that comprises any resistance to flow for the combined flow. Thus, the throttle can also be substituted for by a flow widening. The effect of this flow widening on the conduct of the combined flow is similar to the effect of a throttle construction.

The duct in accordance with the invention, which becomes narrower at its end, is made most advantageously by machining, preferably milling, the duct into a front face of a metal plate. The set of flow pipes which produces turbulence in the flow and each of which comprises a step-like widening or narrowing is formed into one blank plate by drilling the flow pipes into the plate. The set of pipes is preferably the tube manifold placed right after the stock inlet header or the turbulence generator placed after an intermediate chamber. Similarly, in a construction in accordance with the invention, the ends of the dilution liquid duct are formed into the single plate by machining a narrowing duct end into the construction, out of which narrowing duct end the branch ducts are branched to the flow pipes intended for the stock flow.

In an embodiment of the invention, the ducts in the set of flow pipes, which comprises at least one stepwise widening producing turbulence in the flow, preferably in the tube manifold or in the turbulence generator, comprise module-like units, in which connection the pipes in the tube manifold are formed in each module by turning or drilling and moreover, the end of the dilution flow duct is formed in each module by milling the end onto the front face of the module. When the modules are formed in the manner mentioned above by drilling and milling and when the modules are assembled side by side, a unit of construction is obtained which can be constructed relatively easily. The throttle is placed in the tube manifold directly after the point of introduction of the dilution fluid has been made by turning a conical hole into the metal plate construction.

The arrangement of supply of dilution liquid in accordance with the invention and its modular nature are suitable in particular for the supply of the dilution liquid into connection with the tube manifold. However, the invention is not confined to the point of supply of dilution liquid mentioned above alone, but the dilution liquid can be introduced into a similar construction also at the rear side of the intermediate chamber in connection with the turbulence generator.

A basic embodiment of the arrangement for combining a flow of dilution liquid with a flow of stock from an inlet header of a headbox of a paper/board machine in accordance with the invention includes conduit means for passing the stock flow from the inlet header, which comprise a plurality of conduits extending across a width of the headbox, and dilution flow ducts through which the dilution liquid is passed. Each flow duct is in flow communication with at least two conduits at one of a plurality of discrete locations across the width of the headbox such that the basis weight of a paper/board web formed upon discharge from the headbox is regulatable. At least one of the flow ducts, and preferably all, is defined by walls and includes a narrowing duct portion having an upstream end and a downstream end such that a cross-sectional area defined by the walls at the upstream end is greater than a cross-sectional area defined by the walls at the downstream end. The arrangement also includes at least two branch ducts in flow communication with the narrowing duct portion of each flow duct and each branch duct leads to a respective one of the at least two conduits.

In some embodiments, the narrowing duct portion of the flow duct(s) is conical and all of the branch ducts in flow communication with each flow duct lead to one of the conduits in a respective vertical column of the conduits at a specific one of the locations across the width of the headbox. The conduit means may comprise a tube manifold comprising aligned vertical columns and horizontal rows of conduits and whereby each flow duct is associated with a respective vertical column of conduits. The branch ducts in flow communication with each flow duct are associated with a respective conduit in the respective vertical column. In this case, each conduit may includes at least one step for producing turbulence arranged after the branch duct in the flow direction of stock through the conduits. Such a step constitutes means for providing a change in the cross-sectional flow area of stock through the conduits in order to produce turbulence and enhance mixing of the dilution liquid and the stock.

The arrangement may include a throttle plate having a plurality of throttle holes, each including a conical narrowing section, and being arranged in relation to the conduits such that one of the throttle holes in the throttle plate is aligned with each of the conduits. The throttle plate may also be arranged in relation to the branch ducts such that a forward edge of the throttle holes adjoins a rear edge of the branch ducts.

The method for combining a flow of dilution liquid with a flow of stock from an inlet header of a headbox of a paper/board machine at a location between the inlet header and a slice cone of the headbox in accordance with the invention comprising the steps of passing the stock flow from the inlet header through conduit means comprising a plurality of conduits extending across a width of the headbox, and passing dilution liquid through a plurality of dilution flow ducts each in flow communication with at least two conduits situated at a discrete position along the width of the headbox. Each flow duct is defined by walls and includes a narrowing duct portion having an upstream end and a downstream end whereby a cross-sectional area defined by the walls at the upstream end is greater than a cross-sectional area defined by the walls at the downstream end. Further, the dilution liquid is passed from each flow duct through at least two branch ducts in flow communication with the narrowing duct portion of the flow duct and into a respective one of the at least two conduits.

The conduit means may be arranged at any location between the inlet header and the slice cone. For example, the stock flow may be passed from the inlet header directly into the conduit means arranged directly adjacent the inlet header. In the alternative, the stock flow may be passed from the inlet header directly into a tube manifold, from the tube manifold into and through an equalizing chamber, and thereafter from the equalizing chamber into the conduit means.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which:

FIG. 1B is an illustration in part of the construction of FIG. 1A viewed from above;

FIG. 4D shows a throttle plate placed at the outlet side of the tube manifold (in the flow direction of the stock) and is substantially similar to the sectional view shown in FIG. 4B;

FIG. 5 shows an embodiment of the invention which is in the other respects similar to the sectional view of FIG. 4C, except that in this embodiment the branch ducts are milled into the construction so that the flow is directed against the stock flow L1;

FIG. 7A shows an embodiment of the invention in which one structural wall of the conically narrowing duct $D_1$ is formed by a side wall of an adjacent module;

FIG. 7B is a sectional view taken along the line V—V in FIG. 7A;

FIG. 8B shows the construction of FIG. 8A viewed from above; and

DETAILED DESCRIPTION OF THE PREFERRED EMBODIMENTS

Figure 1A:
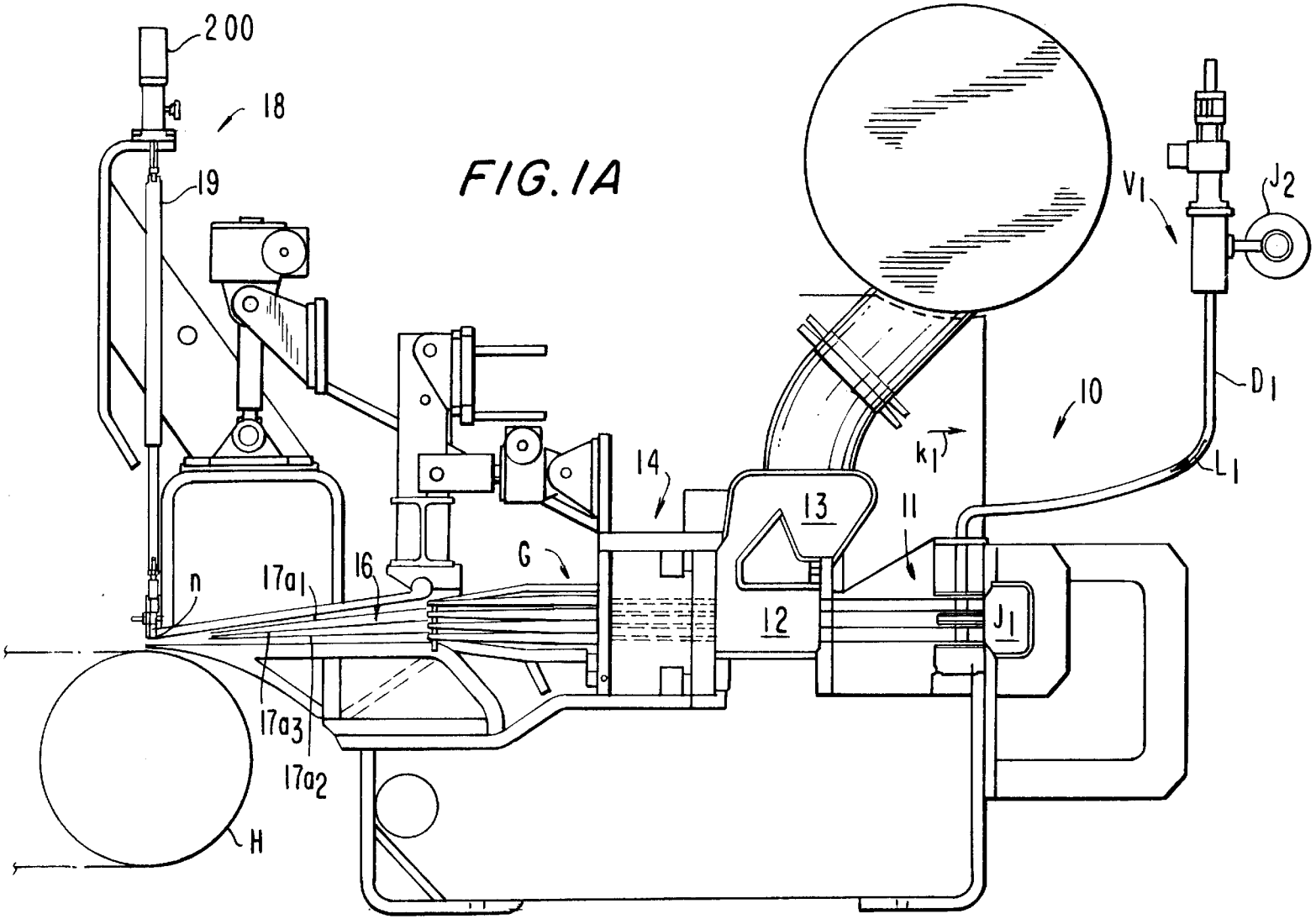
FIG. 1A is a sectional view of the headbox of a paper/board machine showing an arrangement for supplying dilution liquid in connection with the tube manifold placed after the inlet header in accordance with the invention.

Referring to the accompanying drawings wherein like reference numerals refer to the same or similar elements, as shown in FIG. 1A, a headbox 10 of the paper/board machine comprises an inlet header J, conduit means for producing turbulence in the stock flow arranged after the inlet header J in the stock flow direction, such as a system or set of pipes 11 (also referred to as a tube manifold herein), and an intermediate chamber 12 arranged after the set of pipes 11 which opens into a stilling chamber 13. After the intermediate chamber 12, there are conduit means such as a second set of pipes which produces turbulence in the stock flow, i.e., a turbulence generator G. The turbulence generator G includes a grid of pipes which lead into a slice cone 16 which comprises lamellae $\mathbf{17}a_1$, $\mathbf{17}a_2$,$\mathbf{17}a_3$. The stock is passed out of the slice cone 16 through an outflow gap or opening onto a forming wire H or other press forming surface. The grid of pipes may comprise aligned horizontal rows and vertical columns of pipes.

As shown in FIG. 1A, the outflow opening after the slice cone 16 comprises a top slice bar n and a mechanism 18 for regulating the top slice bar n. More specifically, the position of the top slice bar n can be regulated by means of adjustment spindles 19 and adjustment motors 200 included in the regulation mechanism 18.

The flow $L_1$ of a dilution liquid into the stock flow in the headbox 10 is regulated by means of valves $V_1$, $V_2$, . . . (FIG. 1C) To this end, the arrangement in accordance with the invention comprises a plurality of distribution ducts $D_1$,$D_2$, . . . for passing a dilution flow across substantially the entire width of the headbox, in which connection the desired dilution flows can be introduced into different locations of width across the headbox, and the flows can be regulated at each location of width by regulating the respective valve $V_1$,$V_2$, . . . of the dilution flow. As shown in FIG. 1A, the dilution liquid, preferably dilution water, may be passed into any number of different locations of width across the headbox of the paper machine so that the dilution water is passed into the pipes $\mathbf{11}a_{1.1}$, $\mathbf{11}a_{1.2}$, $\mathbf{11}a_{1.3}$, $\mathbf{11}a_{2.1}$, $\mathbf{11}a_{2.2}$, $\mathbf{11}a_{2.3}$, $\mathbf{11}a_{3.1}$, $\mathbf{11}a_{3.2}$, $\mathbf{11}a_{3.3}$, . . . in each vertical row in the tube manifold 11. In other words, a valve is associated with each of the distribution ducts which provides a dilution flow to one or more of the pipes in one vertical column of pipes in the tube manifold 11, at a discrete location of width, depending on the number of rows of such pipes. In certain embodiments, there may be a single dedicated valve $V_1$,$V_2$, . . . for each flow duct $D_1$, $D_2$, . . .

FIG. 1B illustrates the construction as shown in FIG. 1A viewed from above and shows a plurality of pipes $\mathbf{11}a_{1,1}$, . . . $\mathbf{11}a_{n-1,1}$, $\mathbf{11}a_{n,1}$ in a single horizontal row in the tube manifold 11. A respective one of the ducts $D_1$, . . . , $D_{n-1}$, $D_n$ is situated alongside each of the pipes.

Figure 1C:
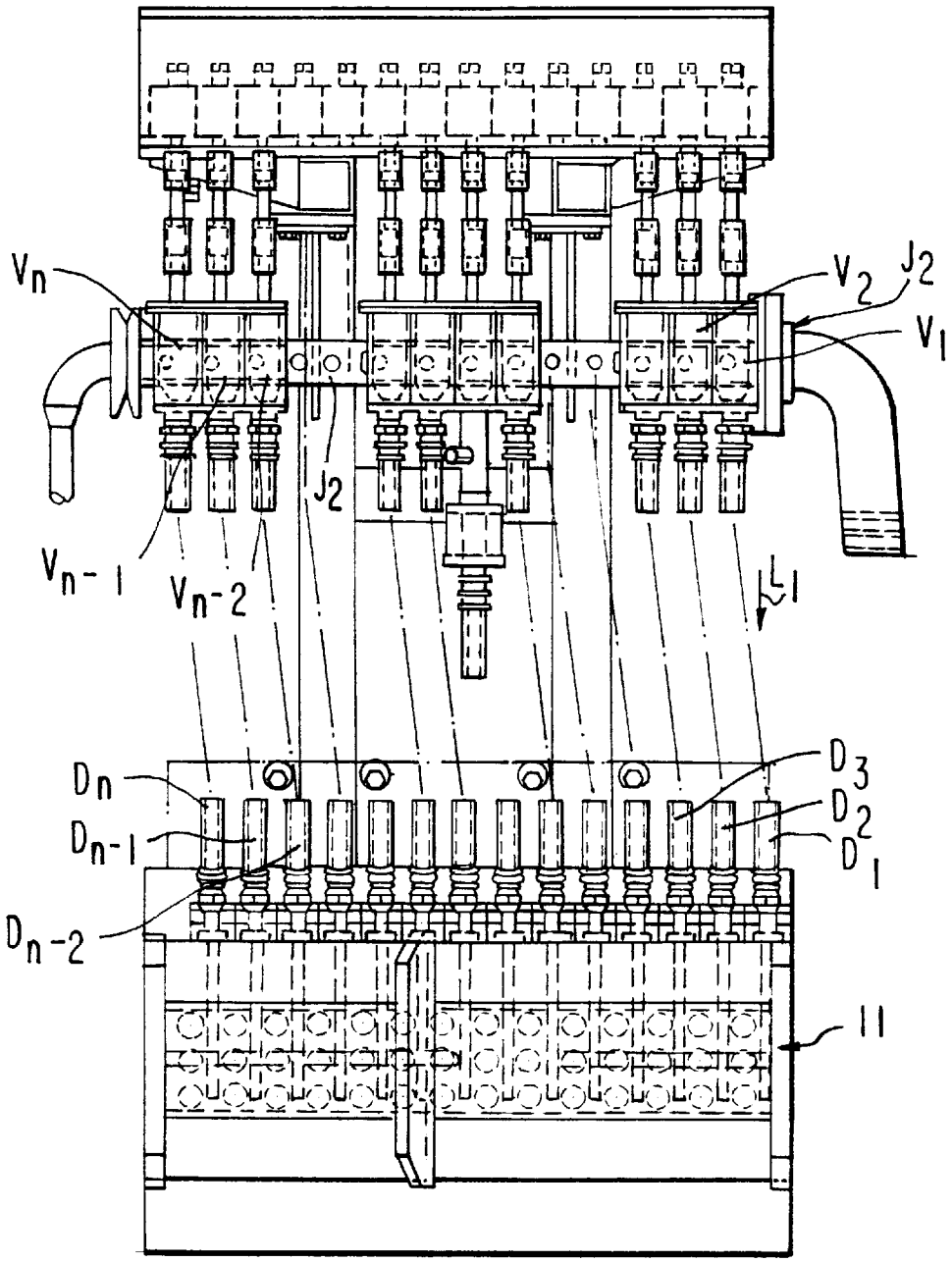
FIG. 1C shows the set of valves for the regulation of the dilution liquid viewed in the direction of the arrow $K_1$ in FIG. 1A.

FIG. 1C illustrates the system of valves $V_1$,$V_2$,$V_3$, . . . , $V_n$ used in the regulation of the dilution liquid. The dilution liquid is passed from a dilution liquid inlet header $J_2$ into the dilution liquid supply or distribution ducts $D_1$, $D_2$, . . . , $D_n$ through the respective valves $V_1$, $V_2$, . . . , $V_n$. By means of the valves, the flow of the dilution liquid $L_1$ may be regulated in each duct $D_1$,$D_2$, . . . $D_n$ independently from the flow of dilution liquid $L_1$ through the other ducts. In this embodiment, there are three aligning rows of pipes in the tube manifold 11 and each dilution duct $D_1$,$D_2$, . . . , $D_n$ is in flow communication with the pipes in one of the vertical columns of pipes thus formed in the tube manifold 11.

Figure 2:
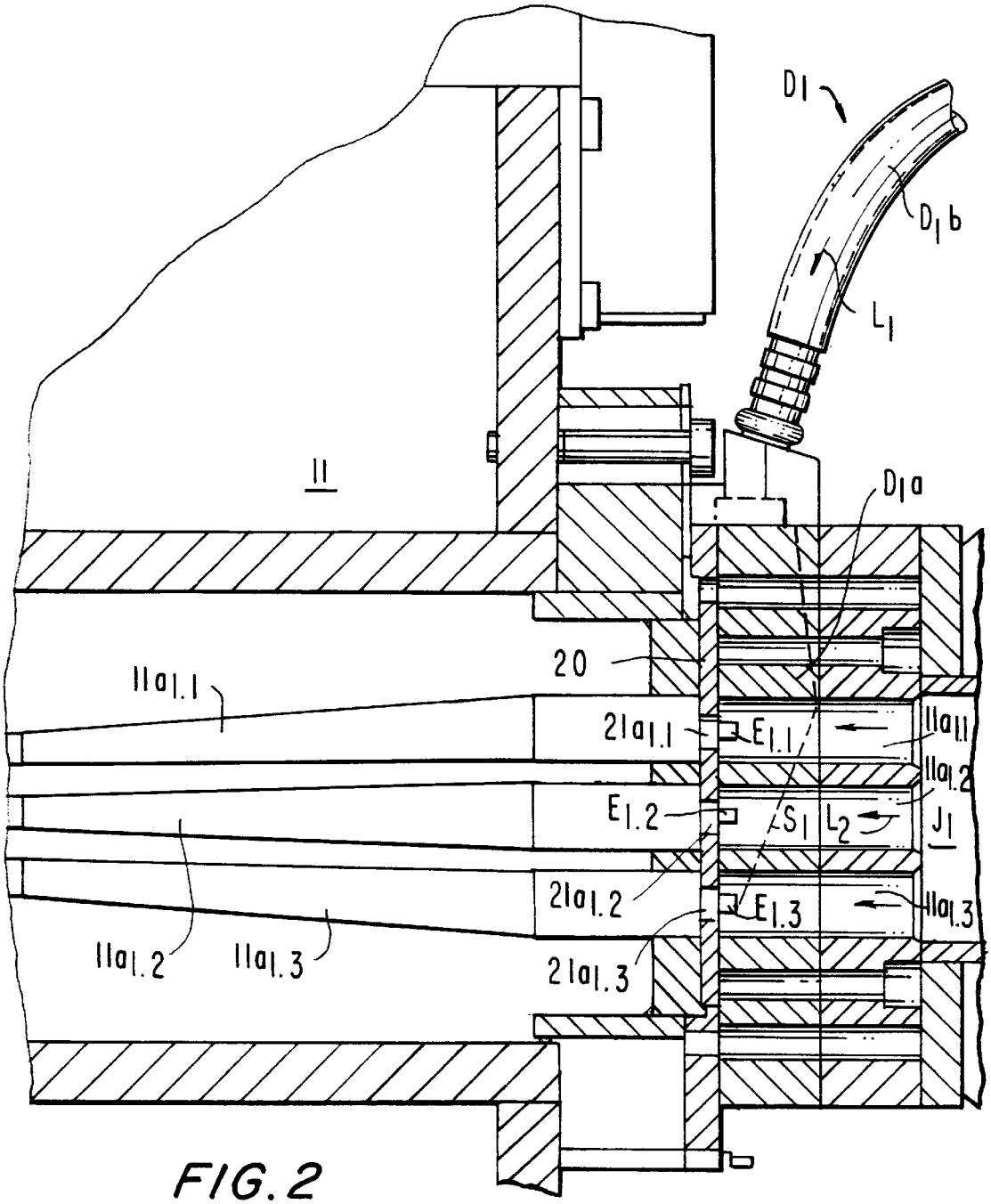
FIG. 2 is a sectional view taken along the line I—I in FIG. 1B showing the supply of dilution liquid into tube manifold on a larger scale.
Figure 9:
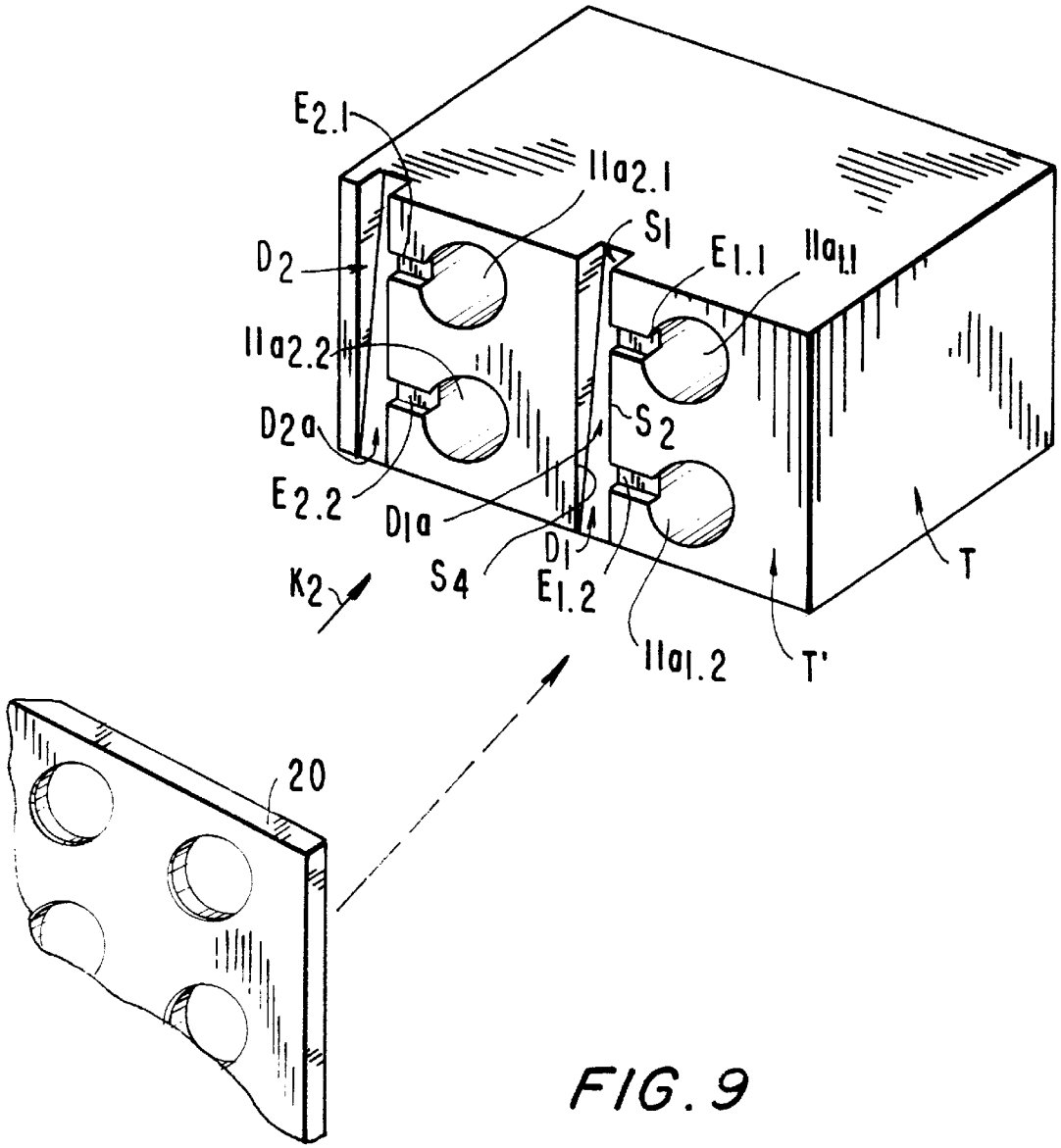
FIG. 9 shows an embodiment of the construction in accordance with the invention in which the stock ducts and the dilution liquid ducts are made in a single plate by machining and the plate extends across the entire width of the headbox.

FIG. 2 is a sectional view taken along the line I—I in FIG. 1B. As shown in FIG. 2, a stock flow $L_2$ is passed from the inlet header $J_1$ into each pipe $\mathbf{11}a_{1.1}$, $\mathbf{11}a_{1.2}$, $\mathbf{11}a_{1.3}$, $\mathbf{11}a_{2.1}$, $\mathbf{11}a_{2.2}$, $\mathbf{11}a_{2.3}$, $\mathbf{11}a_{3.1}$, $\mathbf{11}a_{3.2}$, $\mathbf{11}a_{3.3}$, . . . in the tube manifold 11. The dilution liquid is passed as a dilution flow $L_1$ into each pipe $\mathbf{11}a_{1.1}$, $\mathbf{11}a_{1.2}$, $\mathbf{11}a_{1.3}$ in a vertical row in the tube manifold (each vertical column containing three pipes in the illustrated embodiment, although the amount of pipes in the rows may differ from this amount). The flow is passed through the distribution duct $D_1$ or equivalent distribution system into the vertical column in the tube manifold 11 and further into each pipe $\mathbf{11}a_{1.1}$, $\mathbf{11}a_{1.2}$, $\mathbf{11}a_{1.3}$. Similarly, in the other different locations of width and vertical sections in the tube manifold, the dilution flow is passed out of the distribution ducts $D_2$, $D_3$, . . . , $D_n$ into the pipes $\mathbf{11}a_{2.1}$, $\mathbf{11}a_{2.2}$, $\mathbf{11}a_{2.3}$, $\mathbf{11}a_{3.1}$, $\mathbf{11}a_{3.2}$, $\mathbf{11}a_{3.3}$ in the respective vertical column at corresponding locations in the tube manifold 11. As shown in FIG. 2, a representative distribution duct $D_1$ for dilution flow becomes narrower at the final or downstream end so that the narrowing of the duct $D_1$ takes place towards the lowest pipe $\mathbf{11}a_{1.3}$ in the tube manifold 11. As illustrated in FIG. 2 by means of dashed lines, the duct portion $D_{1a}$ of the duct $D_1$, which has been formed between the rows of pipes in the system of pipes, has additionally been formed so that its wall portion $S_1$ in a narrowing section of the duct $D_1$ is inclined in relation to the vertical plane. The branch ducts are opened from a side wall $S_2$ of the duct portion $D_{1a}$, which is adjacent to the wall portion $S_1$, into the pipes $\mathbf{11}a_{1.1}$, $\mathbf{11}a_{1.2}$, . . . in the vertical columns in the set of pipes 11 (FIG. 9).

By means of the narrowing arrangement of the ducts, the pressure can be kept substantially constant in all outlets $E_{1.1}$,$E_{1.2}$,$E_{1.3}$ of the duct $D_1$ (since a certain quantity of the dilution liquid is removed from each outlet and thus the quantity of dilution liquid at the lowest outlet is less than the quantity of dilution liquid at the uppermost outlet). As shown in FIG. 2, the cross-sectional shape of the distribution ducts $E_{1.1}$, $E_{1.2}$, $E_{1.3}$ branched from the dilution flow duct $D_1$ is rectangular.

Similarly, the cross-sectional shape of the downstream end $D_{1a}$ of the duct $D_1$ is rectangular, and the narrowing duct shape may be produced by machining or milling the end wall $S_1$, which is inclined in relation to the vertical plane, in the end area of the duct $D_1$. The duct portion $D_{1a}$ of duct $D_1$ is connected with a resilient flexible duct portion $D_{1b}$, which comprises a regulation valve $V_1$ at its end (FIG. 1C). As shown in FIG. 1C, the dilution liquid is passed into the duct $D_1$ out of the dilution liquid inlet header $J_2$ through the regulation valve $V_1$.

The outlets of the branch ducts $E_{1.1}$, $E_{1.2}$, $E_{1.3}$ into the pipes $\mathbf{11}a_{1.1}$, $\mathbf{11}a_{1.2}$, $\mathbf{11}a_{1.3}$ in the tube manifold 11 are placed at the forward side of a throttle section $\mathbf{21}a_{1.1}$, $\mathbf{21}a_{1.2}$, $\mathbf{21}a_{1.3}$ in relation to the flow direction $L_2$ of the stock. The throttles $\mathbf{21}a_{1.1}$, $\mathbf{21}a_{1.2}$, $\mathbf{21}a_{1.3}$ are a conical contraction of the duct which terminates in a straight duct portion $\mathbf{22}a_{1.1}$, $\mathbf{22}a_{1.2}$, $\mathbf{22}a_{1.3}$ (FIG. 4D). The most economical embodiment is a construction in which there is one single plate into which the pipes $\mathbf{11}a_{1.1}$, $\mathbf{11}a_{1.2}$, $\mathbf{11}a_{1.3}$, $\mathbf{11}a_{2.1}$, $\mathbf{11}a_{2.2}$, $\mathbf{11}a_{2.3}$, . . . formed into this plate of the tube manifold 11 have been made by drilling, the branch ducts $E_{1.1}$, $E_{1.2}$, $E_{1.3}$ having been made into the front face T' of the plate by machining (FIG. 3).

The pipes $\mathbf{11}a_{1.1}$, $\mathbf{11}a_{1.2}$, $\mathbf{11}a_{1.3}$, $\mathbf{11}a_{2.1}$, $\mathbf{11}a_{2.2}$, $\mathbf{11}a_{2.3}$, . . . in the tube manifold 11 comprise two portions of sets of pipes, i.e., pipes that have been machined, preferably drilled, into a separate plate and separate pipe components connected therewith.

Figure 3:
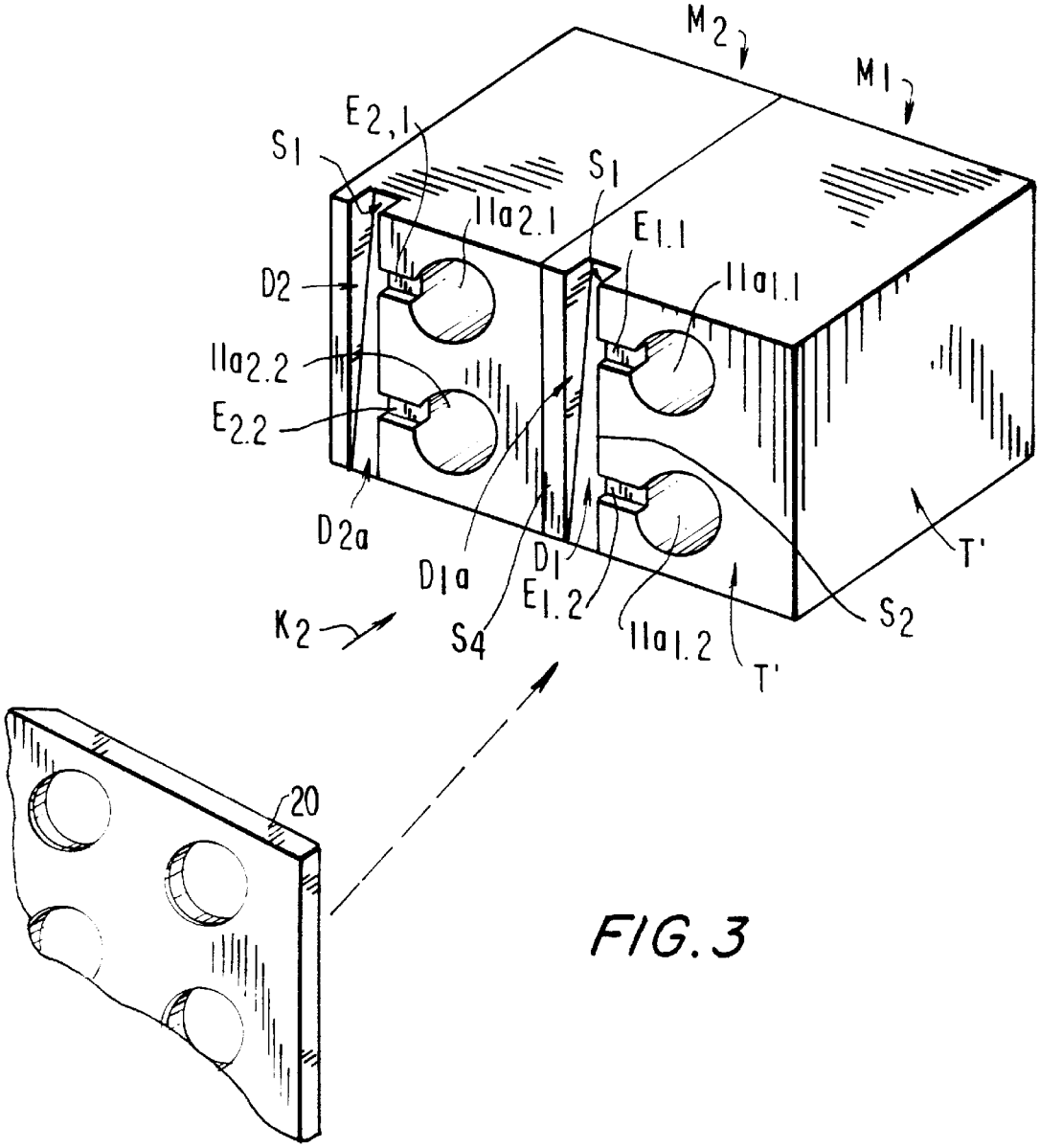
FIG. 3 is a perspective view of modular construction components $M_1$ and $M_2$.
Figure 4A:
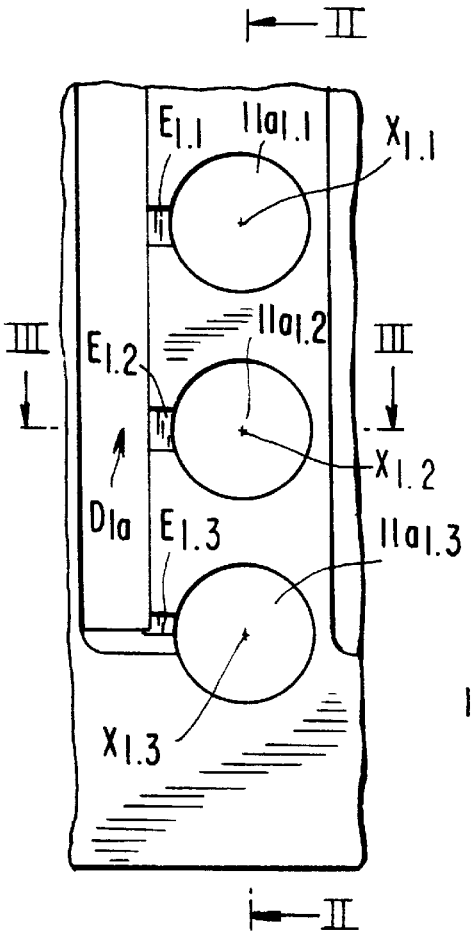
FIG. 4A is an illustration in part of the module $M_1$ shown in FIG. 3 viewed in the area of the tube manifold in the direction of the arrow $K_2$ in FIG. 3.

FIG. 3 illustrates the modular structural components $M_1$ and $M_2$ in a mixing part of the tube manifold 11 in accordance with one embodiment of the invention. The structural components or modules $M_1, M_2, \ldots$ are preferably metallic plates T, into which the pipes $\mathbf{11}a_{1.1}$, $\mathbf{11}a_{1.2}$, $\mathbf{11}a_{1.3}$ in the initial part of the tube manifold 11 have been made by drilling into the plate T. As each module $M_1$, $M_2$ has been made as a separate structural component, the ducts $D_1$, $D_2, \ldots$ can be formed into the module, more specifically, onto the front faces T' of the modules $M_1$, $M_2 \ldots$, in a relatively easy manner, e.g., by milling. Similarly, the narrowing shape of the ducts $D_1$, $D_2$ toward the end in the end portions $D_{1a}$, $D_{2a} \ldots$ of the ducts can be accomplished by making the end wall $S_1$ of the duct $D_1$, $D_2 \ldots$, whose cross-sectional shape is otherwise rectangular, inclined in the area of the end portion $D_{1a}$, $D_{2a} \ldots$ Similarly, the branch ducts $E_{1.1}, E_{1.2}, E_{1.3} \ldots, E_{2.1}, E_{2.2}, E_{2.3}, E_{3.1}, E_{3.2}, E_{3.3}$ may also be made relatively easily by milling them into the front wall T' of the plate T of each module $M_1$, $M_2, \ldots$ In the embodiment shown in FIG. 3, the ducts $E_{1.1}$, $E_{1.2}$, $E_{1.3}$, are arranged in a direction perpendicular to the central axes $X_{1.1}$, $X_{1.2}$, $X_{1.3}$ of the pipes $\mathbf{11}a_{1.1}$, $\mathbf{11}a_{1.2}$, $\mathbf{11}a_{1.3}$ in the tube manifold 11 (FIG. 4A). In such a case, the flows $L_1$ and $L_2$ meet each other at a right angle.

Figure 4B:
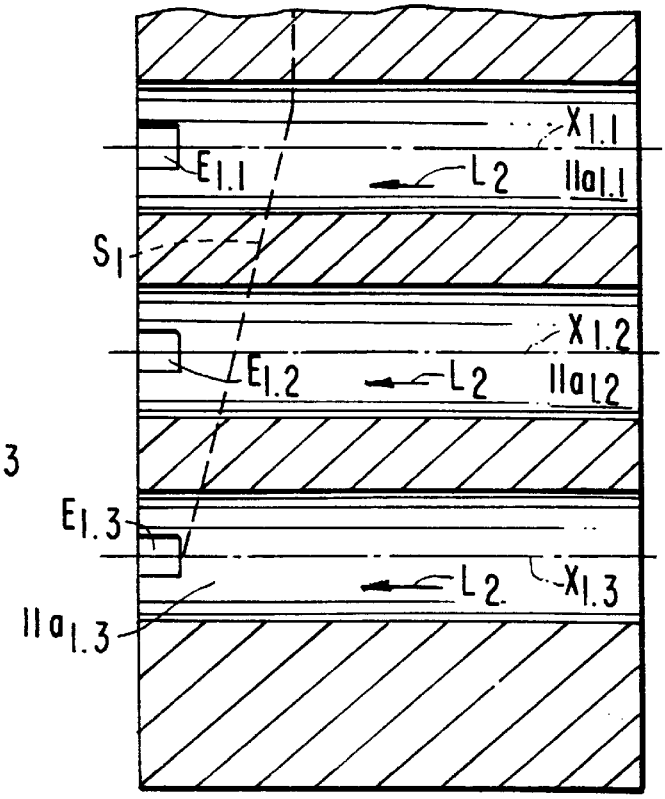
FIG. 4B is a sectional view taken along the line II—II in FIG. 4A.
Figure 4C:
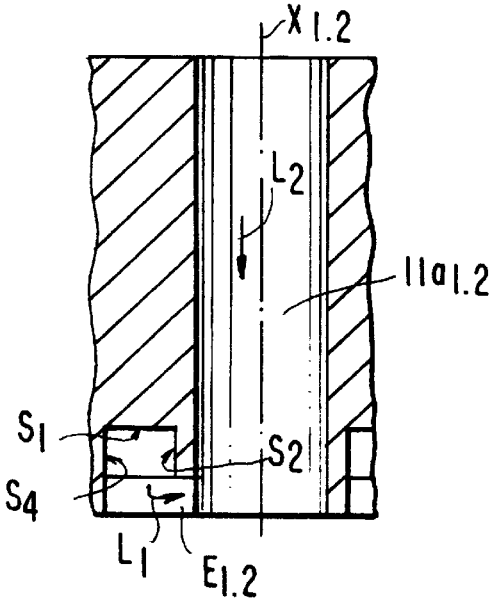
FIG. 4C is a sectional view taken along the line III—III in FIG. 4A.

The specific features of the embodiment shown in FIG. 3 can be seen in greater detail in FIGS. 4A, 4B and 4C wherein FIG. 4A shows the module $M_1$ viewed in the direction of the arrow $K_2$ in FIG. 3, FIG. 4B is a sectional view taken along the line II—II in FIG. 4A and FIG. 4C is a sectional view taken along the line III—III in FIG. 4A. The illustrations in FIGS. 4B and 4C do not show the throttle plate 20, but the fitting of this plate in connection with the construction is illustrated in FIG. 4D. As shown in FIG. 4C, the walls $S_1$, $S_2$ and $S_4$ define in part the flow duct D (complemented by the fourth wall which is provided by the throttle plate 20) whereby each branch duct communicates with the flow duct D through an opening in wall $S_2$.

FIG. 4D shows the throttle plate 20 in connection with the front part, i.e. , the plate T, in the tube manifold 11. At the outlet side of the throttle plate 20, the separate pipes in the final part of the tube manifold 11 are placed, as shown in FIG. 2. Also, it can be seen that the openings in the throttle plate 20 aligning with the pipes in the tube manifold 11 have a smaller cross-sectional area to thus constitute throttle means. In particular, each opening narrows conically from the same dimension as the pipes a certain distance and thereafter has a uniform cross-section. Other flow variation structures may be used in accordance with the invention.

FIG. 5 shows a second embodiment of the invention, which is in the other respects similar to the sectional view in FIG. 4C, except that in this embodiment a representative branch duct $E_{1.2}$ is; and milled into the construction so that the flow direction of the flow $L_1$ out of the duct $D_1$ can be directed so that it is oblique against the flow $L_2$ coming from the dilution liquid inlet header. In other words, the flow $L_1$ is directed against the flow $L_2$. In such a case, the mixing of the dilution flow $L_1$ and the stock flow $L_2$ is more efficient. The embodiment of FIG. 5 is mainly similar to the sectional view in FIG. 4C. The branch ducts D are thus constructed to enable a collision between the dilution liquid flowing from the branch ducts D and the stock flow passing through the pipes in the tube manifold 11.

Figure 6A:
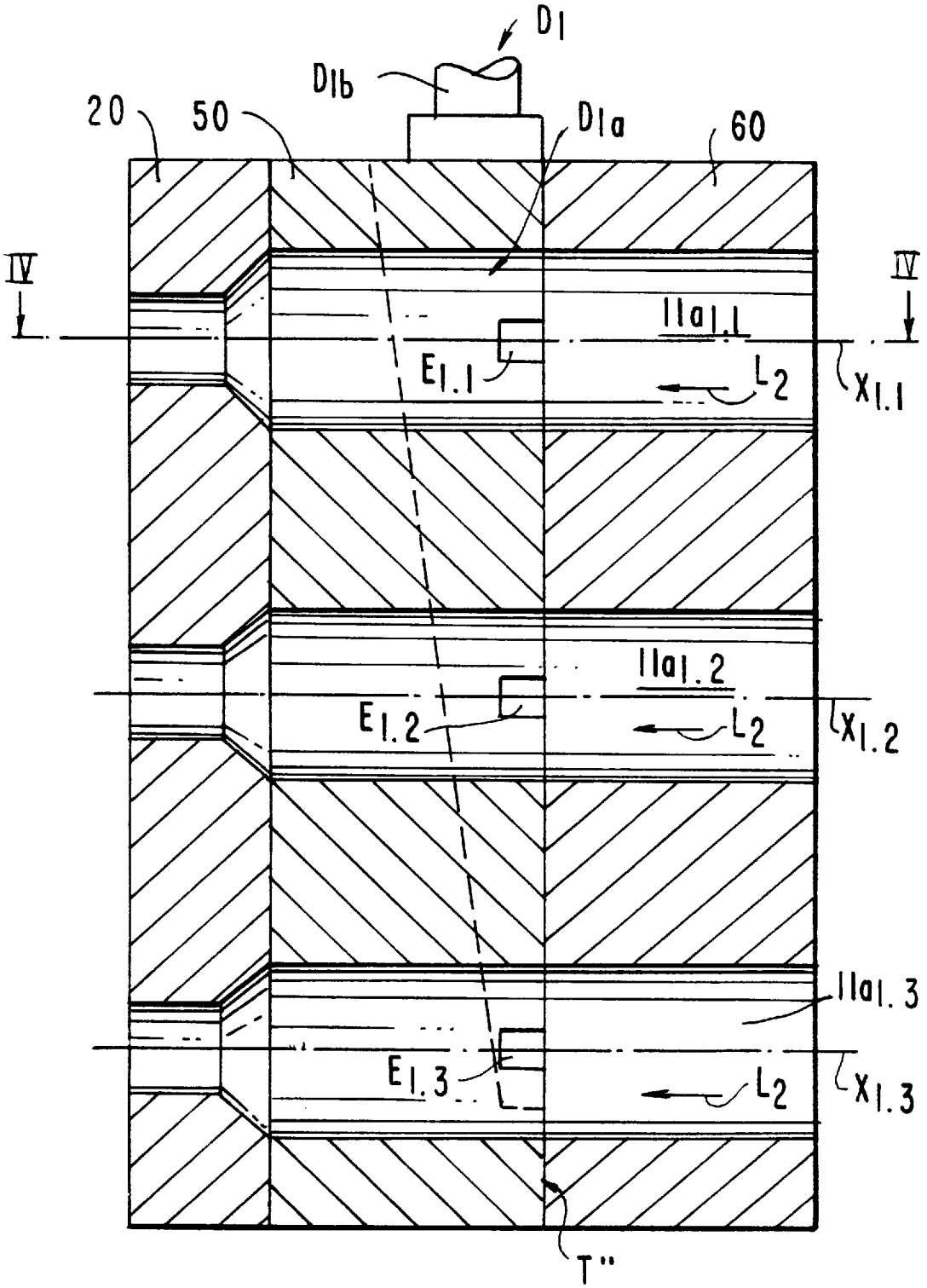
FIG. 6A shows a second embodiment of the arrangement of supply of dilution liquid.
Figure 6B:
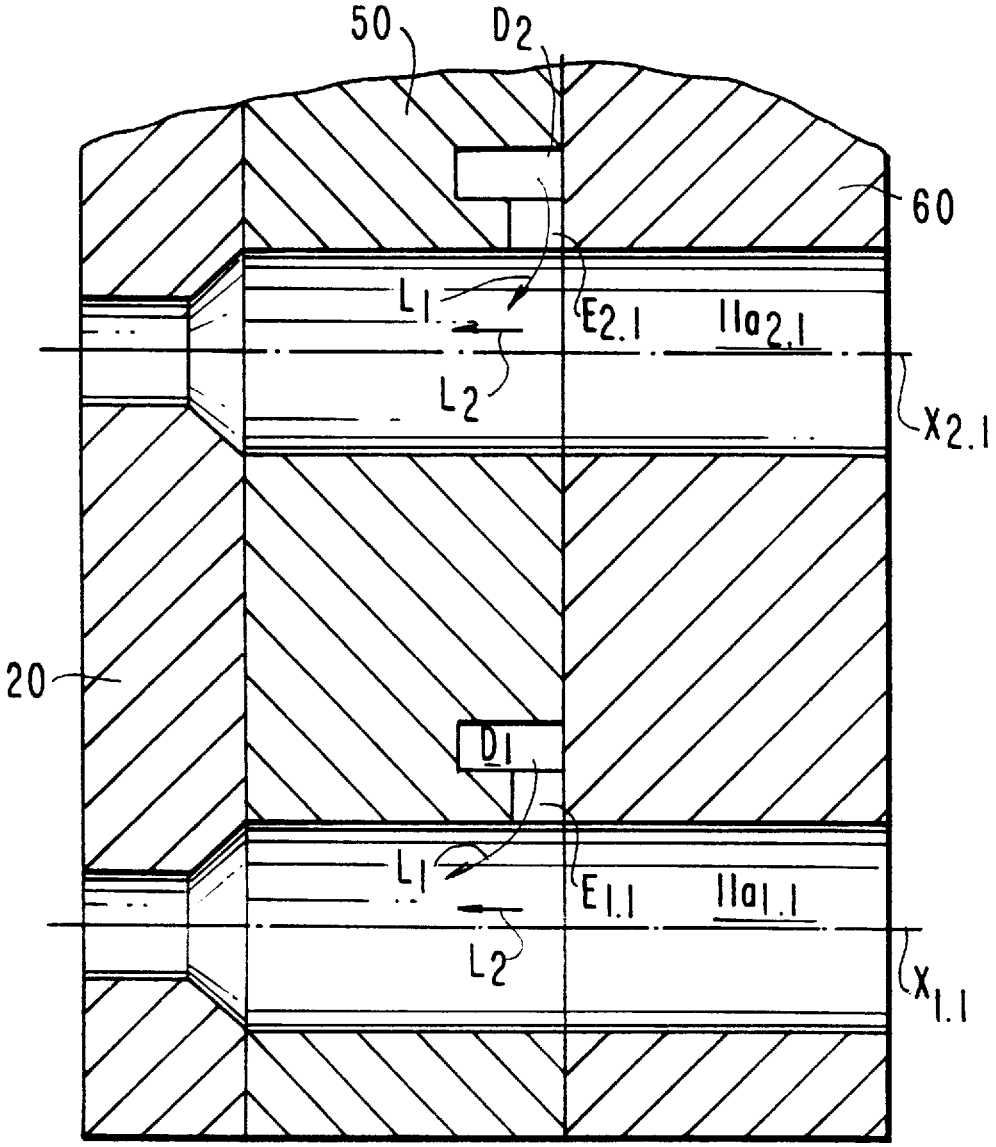
FIG. 6B is a sectional view taken along the line IV—IV in FIG. 6A.

FIG. 6A shows an embodiment of the invention in which the duct portions $D_{1a}$, $D_{2a}, \ldots$ of the ducts $D_1$, $D_2, \ldots$ are formed into a construction plate 50, which is placed alongside the throttle plate 20 and so that the narrowing duct portion $D_{1a}$, $D_{2a}, \ldots$ is arranged to be opened from the front face T" of the plate 50 such that the cleaning of the duct system $D_{1a}$, $D_{2a}, \ldots$ can be carried out by detaching a separate plate 60, which contains the initial part of the system of flow ducts ($\mathbf{11}a_{1.1}$, $\mathbf{11}a_{1.2}, \ldots, \mathbf{11}a_{2.1}$, $\mathbf{11}a_{2.2}$, intended for the flow $L_2$ coming from the inlet header $J_1$. Thus, when the plate 60 is detached, the narrowing ducts $D_{1a}$, $D_{2a}, \ldots$ and the connected branch ducts $E_{1.1}$, $E_{1.2}$ are opened for cleaning, and the extension portion $D_{1b}$, $D_{2b}, \ldots$ connected with the narrowing duct $D_{1a}$, $D_{2a} \ldots$ does not interfere with the washing of the system of ducts, but such washing can be carried out by detaching the plate 60. FIG. 6B is a sectional view taken along the line IV—IV in FIG. 6A. In this embodiment, the combined dilution liquid and stock flow pass through the pipes in plate 50 before passing through the throttle plate 20 since the flow ducts D communicate with an initial region of the pipes in plate 50 encompassing the edge of plate 50 adjacent plate 60.

FIG. 7A illustrates a plate-like module $M_1$, $M_2$ in accordance with the invention. The illustration in FIG. 7A is taken generally in the direction of the arrow $K_2$ in FIG. 3. The embodiment of FIG. 7A differs from that of FIG. 3 mainly in the respect that one side wall of the adjacent modular structural components, i.e. , of the modules $M_1$, $M_2$, is defined by the respective duct, $D_1$ in this case.

Thus, in this embodiment, one wall $S_4$ of the conical portion $D_{1a}$ of the duct $D_1$ of module $M_1$ is formed by one side wall $F_1$ of the module $M_2$ adjacent to the module $M_1$. The initial part of the tube manifold 11 has been formed out of plate-like modules $M_1, M_2, M_3, \ldots$ by interconnecting the modules $M_1$, $M_2$, $M_3, \ldots$ in the direction of width of the headbox of the paper/board machine. FIG. 7B is a sectional view taken along the line V—V in FIG. 7A.

Figure 8A:
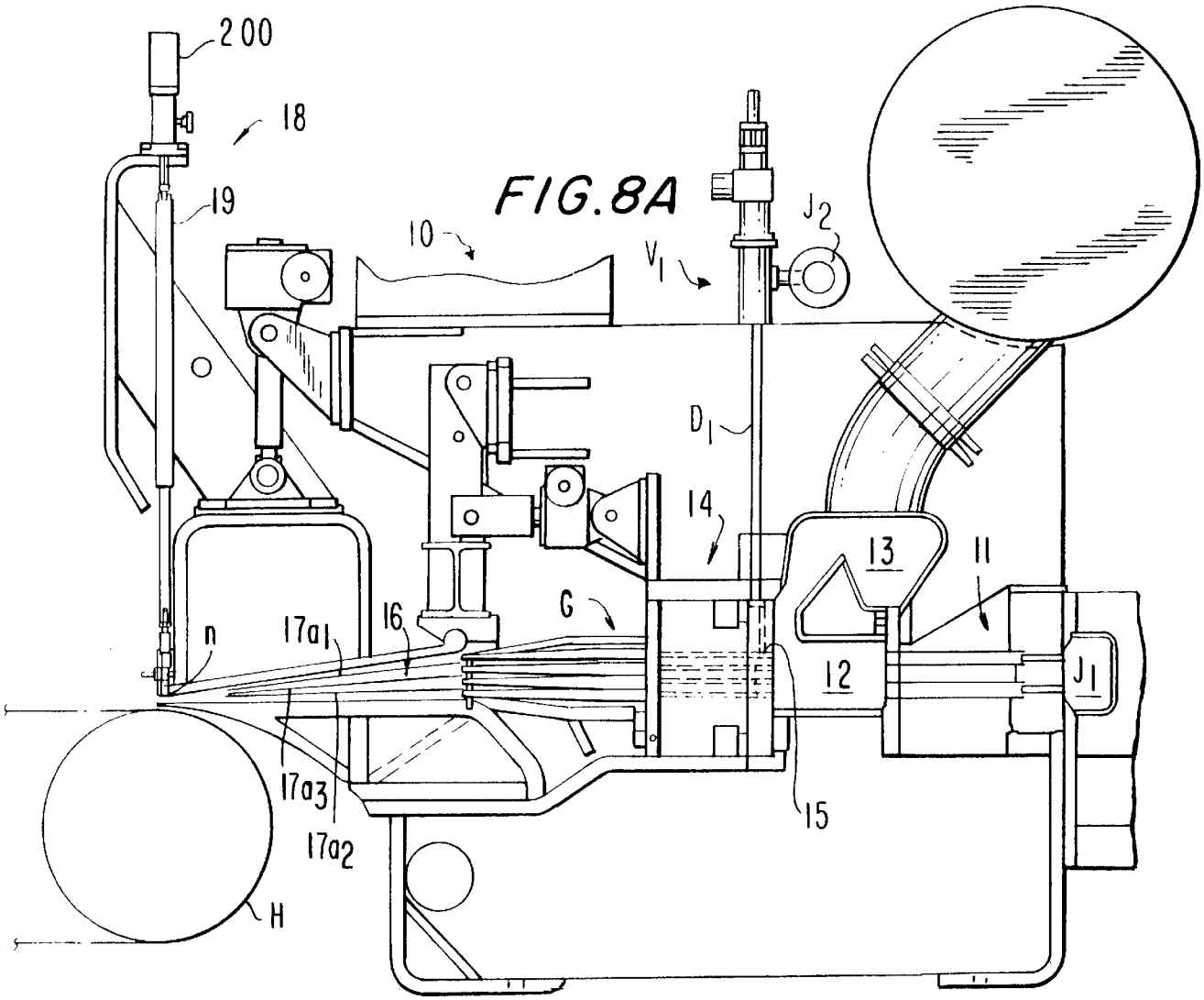
FIG. 8A shows an embodiment of the invention in which the supply of the dilution liquid into the stock flow takes place in a turbulence generator positioned after an intermediate chamber.

FIG. 8A shows an embodiment of the invention in which the mixing of the dilution liquid and the stock flow takes place in the turbulence generator G after the intermediate chamber 12 at the forward end of the pipes of the turbulence generator G in a manner similar to the construction described above. FIG. 8B shows the construction of FIG. 8A viewed from above in the area of the forward end of the turbulence generator G and shows a vertical column of pipes $G_{1.1}, \ldots, G_{n\text{-}1.1}$, $G_{n.1}$. All of the features described above in relation to the embodiment wherein the dilution liquid is passed into the stock flowing through a tube manifold directly following an inlet header may be applied in connection with this or another embodiment wherein the dilution liquid is passed in the stock flowing through a tube manifold (such as a turbulence generator) indirectly following the inlet header, i.e., there may be additional headbox components between the inlet header and the tube manifold. Indeed, the dilution liquid may be introduced into the stock flow in connection with appropriate conduit means at any location between the inlet header and the slice cone.

FIG. 9 is an illustration in part of an embodiment of the invention which comprises narrowing ducts $D_1$, $D_2, \ldots$ for dilution liquid in connection with a tube manifold 11 comprising a single plate-like structural component T. The pipes in the tube manifold 11 may be made into a metallic plate construction in a conventional manner such as by machining, preferably by drilling. The ducts $D_1$, $D_2, \ldots$ that supply dilution liquid may be formed in connection with the front face of the plate construction T, as was the case in the embodiments described above, by milling or some other machining process. The plate T extends across substantially the entire width of the headbox. The construction can also be used in connection with the turbulence generator, after the intermediate chamber, or it can be used in a headbox construction which comprises, after the inlet header $J_1$, only one system of pipes or conduit means that produces turbulence and, after that, the slice cone.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims. For example, the arrangement described above can be used in a method for regulating the basis weight of a web upon its discharge from a headbox of a paper/board machine. In such a method, a stock flow is passed from an inlet header of the headbox through conduit means comprising a plurality of conduits extending across a width of the headbox, dilution liquid is introduced into the stock flow in one of the manners described above, and the flow of the dilution liquid through the flow ducts is regulated. The stock flow may be passed from the inlet header directly into the conduit means arranged directly adjacent the inlet header or in the alternative, from the inlet header directly into a tube manifold, from the tube manifold into and through an equalizing chamber, and then from the equalizing chamber into the conduit means.

I claim:

1. In an arrangement for combining a flow of dilution liquid with a flow of stock from an inlet header of a headbox of a paper/board machine, the arrangement including conduit means for passing the stock flow from the inlet header and dilution flow ducts through which the dilution liquid is passed, said conduit means comprising a plurality of conduits extending across a width of the headbox, the improvement comprising at least one of said dilution flow ducts being defined by walls and including a narrowing duct portion having an upstream end and a downstream end, a cross-sectional area defined by said walls at said upstream end being greater than a cross-sectional area defined by said walls at said downstream end, each of said dilution flow ducts being in flow communication with at least two of said conduits at one of a plurality of discrete locations across the width of the headbox such that the basis weight of a paper/board web formed upon discharge from the headbox is regulatable, and at least two branch ducts in flow communication with said narrowing duct portion of each of said at least one dilution flow duct, each of said branch ducts leading to a respective one of said at least two conduits.

2. The arrangement of claim 1, wherein said narrowing duct portion of said at least one dilution flow duct is conical, all of said branch ducts in flow communication with each of said at least one dilution flow duct leading to one of said conduits in a respective vertical column of said conduits at a specific one of the locations across the width of the headbox.

3. The arrangement of claim 1, wherein said conduit means comprise a tube manifold comprising aligned vertical columns and horizontal rows of conduits, each of said at least one dilution flow duct being associated with a respective one of said vertical columns of said conduits, said branch ducts in flow communication with each of said at least one dilution flow duct being associated with a respective one of said conduits in said respective vertical column.

4. The arrangement of claim 3, wherein each of said conduits includes at least one step for producing turbulence, said at least one step being arranged after said branch duct in the flow direction of stock through said conduits, said at least one step constituting means for providing a change in the cross-sectional flow area of stock through said conduits.

5. The arrangement of claim 1, wherein a first one of said walls defining said narrowing duct portion of said at least one dilution flow duct is inclined in relation to a vertical plane, an opening being defined in a second one of said walls adjacent to said first wall for each of said branch ducts in flow communication with said at least one dilution flow duct.

6. The arrangement of claim 1, further comprising a plate having a front face, at least said narrowing duct portion of said at least one dilution flow duct being formed in said front face of said plate, said conduits being machined into said plate.

7. The arrangement of claim 6, wherein said branch ducts are machined into said front face of said plate.

8. The arrangement of claim 1, further comprising a throttle plate having a plurality of throttle holes each including a conical narrowing section, said throttle plate being arranged in relation to said conduits such that one of said throttle holes in said throttle plate is aligned with each of said conduits.

9. The arrangement of claim 8, wherein said throttle plate is arranged in relation to said branch ducts such that a forward edge of said throttle holes adjoins a rear edge of said branch ducts.

10. The arrangement of claim 8, further comprising a plate having a front face, at least said narrowing duct portion of said at least one dilution flow duct and said branch ducts being machined into said front face of said plate, said throttle holes in said throttle plate further comprising a straight flow duct section arranged after said conical narrowing section in the flow direction, said throttle plate being arranged adjacent said front face of said plate.

11. The arrangement of claim 1, wherein each of said at least one dilution flow duct further comprises a flexible hose in flow communication with said narrowing duct portion.

12. The arrangement of claim 1, wherein said conduit means comprise a plurality of interconnected modules extending in the direction of width of the headbox, each of said modules comprising at least one of said conduits and a peripheral wall constituting one of said walls of an adjacent module.

13. The arrangement of claim 1, wherein said conduit means comprise a tube manifold arranged to receiving the stock flow directly from the inlet header.

14. The arrangement of claim 1, wherein said conduit means comprise a turbulence generator arranged to receiving the stock flow indirectly from the inlet header, the stock flow passing through an intermediate chamber between the inlet header and said turbulence generator.

15. The arrangement of claim 1, wherein said branch ducts are arranged to direct the dilution liquid from an outlet of said branch ducts at an oblique angle in relation to a central axes of said conduits and against the stock flow in said conduits.

16. The arrangement of claim 1, wherein said narrowing duct portion of said at least one dilution flow duct is formed so that one of said walls of said narrowing duct portion is inclined in relation to the vertical plane.

17. The arrangement of claim 1, further comprising first, second and third plates, said narrowing duct portion of said at least one dilution flow duct being formed between a wall of said first plate and a recess in a first face of said second plate and said branch ducts being formed in said first face of said second plate, said conduits being formed in said second plate, said second plate being separable from said first plate to enable access to said at least one dilution flow duct and said branch ducts, said third plate constituting a throttle plate having a plurality of throttle holes and being arranged in relation to a second face of said second plate opposed to said first face such that one of said throttle holes in said throttle plate is aligned with each of said conduits.

18. A method for combining a flow of dilution liquid with a flow of stock from an inlet header of a headbox of a paper/board machine at a location between the inlet header and a slice chamber of the headbox, comprising the steps of:

passing the stock flow from the inlet header through conduit means comprising a plurality of conduits extending across a width of the headbox, passing dilution liquid through a plurality of dilution flow ducts each in flow communication with at least two of said conduits situated at a discrete position along the width of the headbox, each of said dilution flow ducts being defined by walls and including a narrowing duct portion having an upstream end and a downstream end, a cross-sectional area defined by said walls at said upstream end being greater than a cross-sectional area defined by said walls at said downstream end, and passing the dilution liquid from each of said dilution flow ducts through at least two branch ducts in flow communication with said narrowing duct portion of said dilution flow duct and into a respective one of said at least two conduits.

19. The method of claim 18, further comprising the step of:

passing the stock flow from the inlet header directly into said conduit means arranged directly adjacent the inlet header.

20. The method of claim 18, further comprising the steps of:

passing the stock flow from the inlet header directly into a tube manifold, passing the stock flow from the tube manifold into and through an equalizing chamber, and passing the stock flow from the equalizing chamber into said conduit means.

21. A method for regulating the basis weight of a web upon its discharge from a headbox of a paper/board machine, comprising the steps of:

passing a stock flow from an inlet header of the headbox through conduit means comprising a plurality of conduits extending across a width of the headbox, introducing dilution liquid into the stock flow in at least one of said conduits by passing the dilution liquid through at least one of a plurality of dilution flow ducts each leading to at least two of said conduits situated at a discrete position along the width of the headbox, said at least one dilution flow duct being defined by walls and including a narrowing duct portion having an upstream end and a downstream end, a cross-sectional area defined by said walls at said upstream end being greater than a cross-sectional area defined by said walls at said downstream end, and passing the dilution liquid from said at least one dilution flow duct through at least two branch ducts in flow communication with said narrowing duct portion of said at least one dilution flow duct and into one of said conduits, regulating the flow of the dilution liquid through said dilution flow ducts to thereby regulate the basis weight of the web, and discharging the stock flow including the dilution liquid from the headbox to form the web.

22. The method of claim 21, further comprising the step of:

passing the stock flow from the inlet header directly into said conduit means arranged directly adjacent the inlet header.

23. The method of claim 21, further comprising the steps of:

passing the stock flow from the inlet header directly into a tube manifold, passing the stock flow from the tube manifold into and through an equalizing chamber, and passing the stock flow from the equalizing chamber into said conduit means.

* * * * *